US009546016B2

(12) United States Patent
Anderson

(10) Patent No.: US 9,546,016 B2
(45) Date of Patent: Jan. 17, 2017

(54) MATTRESS DISPLAY PACKAGING AND DISPLAY CONTAINER

(71) Applicant: DREAMWELL, LTD., Las Vegas, NV (US)

(72) Inventor: Matthew Anderson, Atlanta, GA (US)

(73) Assignee: DREAMWELL, LTD., Las Vegas, NV (US)

( * ) Notice: Subject to any disclaimer, the term of this patent is extended or adjusted under 35 U.S.C. 154(b) by 421 days.

(21) Appl. No.: 13/689,690

(22) Filed: Nov. 29, 2012

(65) Prior Publication Data

US 2014/0144808 A1 May 29, 2014

(51) Int. Cl.

| | |
|---|---|
| ***B65D 5/50*** | (2006.01) |
| ***B65D 5/68*** | (2006.01) |
| ***B65D 77/02*** | (2006.01) |
| ***B65D 5/02*** | (2006.01) |
| ***B65D 5/12*** | (2006.01) |
| ***B65D 5/42*** | (2006.01) |
| ***B65D 5/496*** | (2006.01) |
| ***B65D 5/52*** | (2006.01) |
| *B65D 85/16* | (2006.01) |

(52) U.S. Cl.

CPC ..... *B65D 5/68* (2013.01); *B65D 5/0227* (2013.01); *B65D 5/12* (2013.01); *B65D 5/4204* (2013.01); *B65D 5/4804* (2013.01); *B65D 5/52* (2013.01); *B65D 77/02* (2013.01); *B65D 85/16* (2013.01); *B65D 2313/02* (2013.01); *B65D 2577/043* (2013.01)

(58) Field of Classification Search

CPC ..... B65B 9/02; B65B 11/025; B65B 25/146; B65B 13/00; B65B 13/20; B65D 85/16; B65D 75/30; B65D 77/0413; B65D 5/0227; B65D 5/12; B65D 5/4804; B65D 5/52;B65D 5/4204; B65D 5/68; B65D 77/02; B65D 2577/043; B65D 2313/02; B65D 19/0004; B65D 85/62; B65D 9/38; E06B 9/02; A45F 5/0018

USPC ..... 206/736, 822, 821, 459.5, 766, 737, 779,206/781, 775, 326, 587, 586, 589, 592, 564,206/454, 756, 764, 750, 600, 597; 5/716, 413 R; 229/162.7, 164; 220/23.87, 23.88, 913, 220/729, 730, 676, 62, 528, 529; 53/484, 394; 455/575.8

See application file for complete search history.

(56) References Cited

U.S. PATENT DOCUMENTS

| | | | | | |
|---|---|---|---|---|---|
| 1,697,664 | A | * | 1/1929 | Schweich | 229/108 |
| 2,040,241 | A | * | 5/1936 | Cortilet | 206/756 |
| 2,076,848 | A | * | 4/1937 | Keiver | 211/28 |
| 2,147,348 | A | * | 2/1939 | Munson et al. | 5/696 |
| 2,767,831 | A | * | 10/1956 | Brecht | 206/423 |
| 2,801,000 | A | * | 7/1957 | Busch | 206/449 |
| 4,053,101 | A | * | 10/1977 | Hart, Jr. | 206/736 |
| 4,257,524 | A | * | 3/1981 | Yonkers et al. | 211/71.01 |
| 4,401,227 | A | * | 8/1983 | Pehr | 215/252 |
| 4,711,348 | A | * | 12/1987 | Schluger | 206/45.29 |
| 5,012,923 | A | * | 5/1991 | Hayes | 206/443 |
| 5,014,888 | A | * | 5/1991 | Bryan | 222/541.5 |

(Continued)

*Primary Examiner* — Anthony Stashick
*Assistant Examiner* — James M Van Buskirk
(74) *Attorney, Agent, or Firm* — Cantor Colburn LLP

(57) ABSTRACT

Mattress packaging displays and the display containers for displaying one or more mattresses in a retail environment generally include a bottom panel, a top panel, sidewalls extending from the bottom panel to the top panel, a front facing panel, and a rear facing panel; wherein the container is seated on the bottom panel during display and comprises at least one opening exposing at least a portion of the mattress, and wherein the container is configured to contain the mattress.

15 Claims, 7 Drawing Sheets

(56) References Cited

U.S. PATENT DOCUMENTS

| | | | | | |
|---|---|---|---|---|---|
| 5,027,748 | A * | 7/1991 | Wolak | 119/168 | |
| 5,035,323 | A * | 7/1991 | Daniels et al. | 206/386 | |
| 5,230,423 | A * | 7/1993 | Gellatly | 206/764 | |
| 5,251,753 | A * | 10/1993 | Pigott et al. | 206/766 | |
| 5,271,498 | A * | 12/1993 | Gillespie | B65D 85/16 | 206/326 |
| 5,762,203 | A * | 6/1998 | Klawiter | B65D 5/542 | 206/736 |
| 5,934,041 | A | 8/1999 | Rudolf et al. | | |
| 6,178,723 | B1 | 1/2001 | Mossbeck | | |
| 6,237,777 | B1 * | 5/2001 | Bierly | 206/758 | |
| 6,270,007 | B1 * | 8/2001 | Jensen, Jr. | 229/122.21 | |
| 6,273,257 | B1 | 8/2001 | Mossbeck | | |
| 7,066,321 | B2 * | 6/2006 | Kawaguchi et al. | 206/77.1 | |
| 7,147,106 | B2 * | 12/2006 | Kowalski et al. | 206/326 | |
| 7,444,706 | B2 * | 11/2008 | Gladney et al. | 5/727 | |
| D593,796 | S * | 6/2009 | Kevan | D34/1 | |
| 8,267,244 | B2 * | 9/2012 | Dunn et al. | 206/223 | |
| 2004/0094452 | A1 * | 5/2004 | Scott et al. | 206/769 | |
| 2008/0314794 | A1 * | 12/2008 | Bowman | 206/756 | |
| 2010/0038369 | A1 * | 2/2010 | Rivas CaNas et al. | 220/592.26 | |
| 2012/0180214 | A1 * | 7/2012 | Borgione | 5/485 | |
| 2012/0187012 | A1 * | 7/2012 | TeVault | B65D 81/055 | 206/326 |

* cited by examiner

MATTRESS DISPLAY PACKAGING AND DISPLAY CONTAINER

BACKGROUND

The present disclosure generally relates to display packaging and containers, and more particularly, to the display packaging of mattresses and display containers packaging and displaying a mattress.

A mattress is a product in demand by consumers generally throughout the year, albeit demand is not necessarily even throughout the year. Mattresses generally include top and bottom planar surfaces and sidewalls extending from the top and bottom planar surfaces, wherein the top and bottom planar surfaces are configured for use as a one sided or a two sided mattress. Mattresses are manufactured in several sizes, the most common sizes being referred to as king size, queen size and standard size. Mattresses are also made in smaller or substandard sizes for special purposes. Characteristically however, most if not all are bulky, relatively heavy, and quite difficult to handle in part because of their flexibility, size and weight. Moreover, it takes considerable space to store mattresses for which reason retail establishments must customarily set aside a relatively large area for the storage and display of mattresses.

The packaging of mattresses for shipping, distribution, handling and eventual sale presents a formidable challenge given the size and nature of the product. In order to provide substantial protection from damage and soiling to maintain the "as new" condition required for retail marketing and sale, widespread use of heavier gauge plastic film as a wrapping material is oftentimes used to encapsulate the mattress. The formation of a plastic film package about a mattress has been automated, as described for example in U.S. Pat. Nos. 5,934,041; 6,178,723 and 6,273,257.

When displayed in retail establishments, the, plastic wrapped mattresses do not provide the support required to stand the mattress on a sidewall and oftentimes require the establishment to stack the mattresses on the planar surfaces or provide additional support structures when seated on a sidewall.

BRIEF SUMMARY

Disclosed herein are mattress packaging displays and the display containers for displaying a mattress in a retail environment In one embodiment, the mattress packaging display comprises a mattress; and a container comprising a bottom panel, a top panel, sidewalls extending from the bottom panel to the top panel, a front facing panel, and a rear facing panel; wherein the container is seated on the bottom panel during display and comprises at least one opening exposing at least a portion of the mattress, and wherein the container is configured to contain the mattress.

The display container for displaying and packaging a mattress display comprises a bottom panel; a top panel; sidewalls extending from the bottom panel to the top panel; a front facing panel transversely extending between the sidewalls; and a rear facing panel transversely extending between the sidewalls; wherein the display container is dimensioned to accommodate a mattress and has at least one opening exposing at least a portion of the mattress when in use.

In another embodiment, a display container for displaying and packaging multiple mattresses comprises a bottom panel at a bottom end of the packaging display; opposing sidewalls extending from the bottom panel; a front facing panel transversely extending between the sidewalls having a height at a fraction of a height of the mattresses to be displayed; and a rear facing panel transversely extending between the sidewalls having a height substantially equal to the height of the mattresses to be displayed, wherein the opposing sidewalls include a portion extending from the rear facing panel having a height that is substantially equal to the height of the rear facing panel and a remaining portion that extends to the front facing panel and transitions to a height greater than or equal to the height at the front facing wall.

In another embodiment, a mattress packaging display for packaging during transport and displaying mattresses at a site, the display comprises a bottom cap upon which the mattresses are seated, the bottom cap comprising a panel and sidewalls upwardly extending about a perimeter of the panel; a wrap comprising a front facing panel, a back facing panel, and sidewalls transversely extending from the back facing panel to the front facing panel, wherein the back facing panel has a height about equal or greater than a length of a mattress to be displayed therein, and wherein the front facing wall has a height at a fraction of the height of the back facing panel to permit display of the mattresses; and divider tubes disposed within the wrap for partitioning mattresses within the mattress packaging display.

The disclosure may be understood more readily by reference to the following detailed description of the various features of the disclosure and the examples included therein.

BRIEF DESCRIPTION OF THE SEVERAL VIEWS OF THE DRAWINGS

Referring now to the figures wherein the like elements are numbered alike.

DETAILED DESCRIPTION

Figure 1:
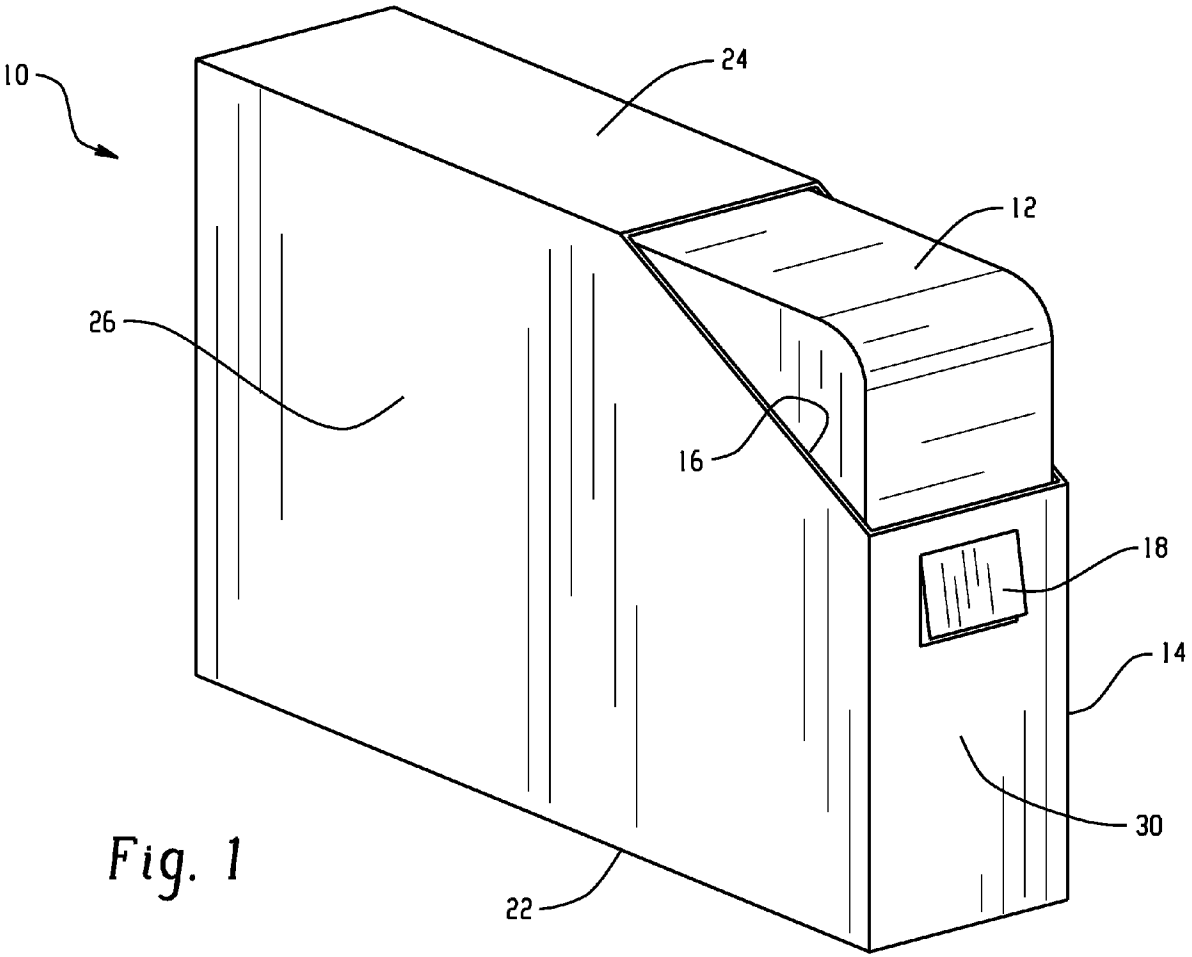
FIG. 1 is a perspective view of a mattress package display in accordance with the present disclosure.

FIG. 1 depicts a perspective view of an exemplary mattress packaging display generally designated by reference numeral 10 in accordance with the present disclosure. The mattress packaging display includes a mattress 12 and a generally rectangular shaped and relatively rigid container 14 (compared to the plastic bagging of the prior art) that approximates the dimensions of the mattress 12 to be contained therein. The mattress is not intended to be limited and may be of any type, dimension, and/or shape. For example, the mattress may be a foam mattress, a coiled mattress, a foam and coil mattress, an air mattress, or the like. Typically, the mattress is square or rectangular shaped and has a thickness ranging from about 4 inches to about 20 inches. The length and width can vary depending on the intended application and typically has a width of about 2 feet to about 7 feet and a length of about 4 feet to about 10 feet, although custom sizes may require smaller or larger dimensions.

The container 14 includes at least one opening 16 of a dimension that permits an end user to view at least a portion of the mattress 12 contained therein. The at least one opening 16 is not intended to be limited to any size, shape, and/or location. The particular location will generally be selected based on orientation of the mattress packaging display within the retail environment. In the exemplary embodiment shown, the at least one opening 16 is at about a corner of the container 12 so as to expose a corner of the mattress 12. In some embodiments, the mattress packaging display 10 may further include a visual and/or tactile display tab 18.

Figure 2:
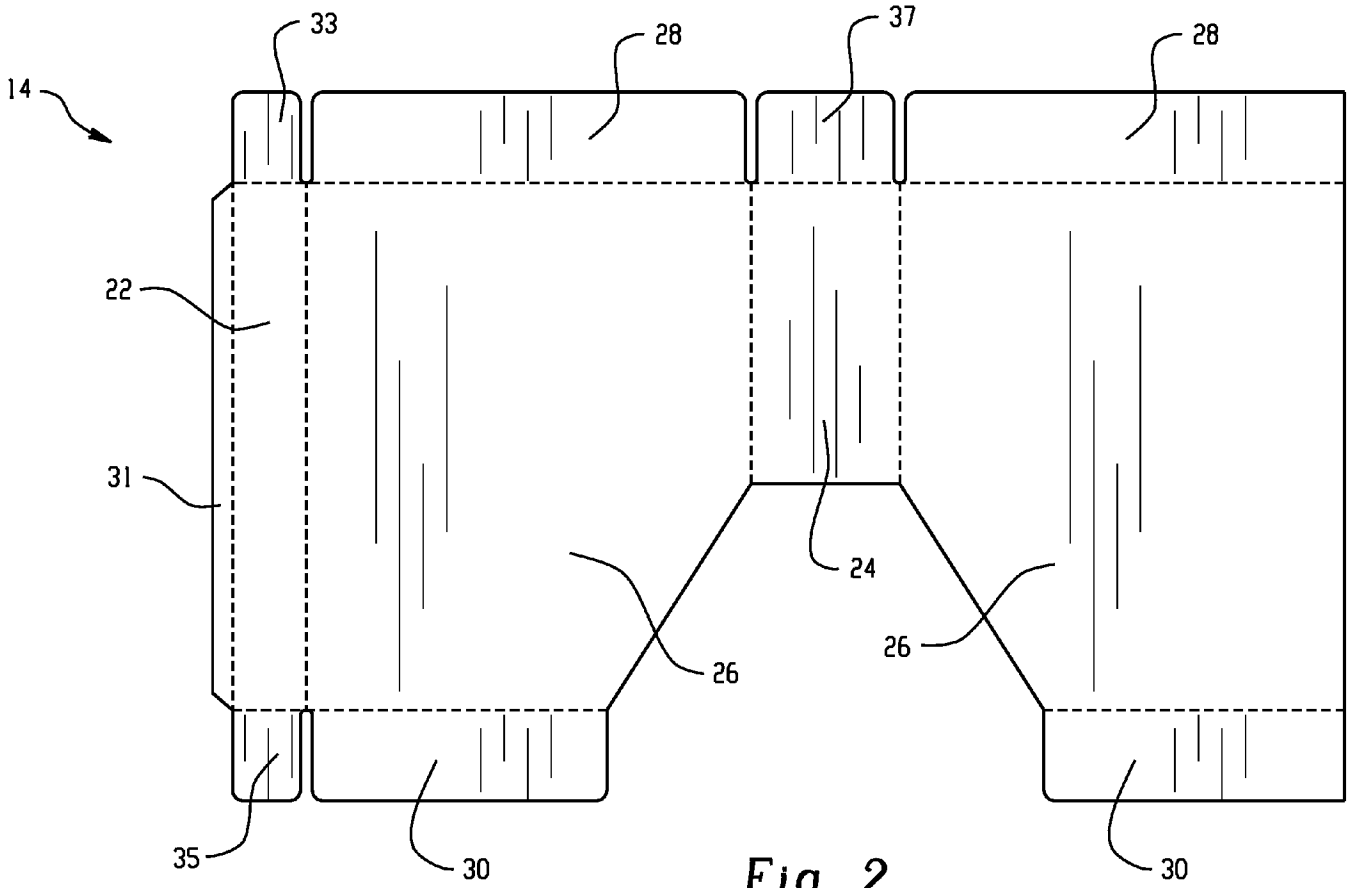
FIG. 2 illustrates the schematics of the mattress packaging display prior to being constructed.

As shown more clearly in FIG. 2, the relatively rigid container 14 is formed of a foldable material such as card or cardboard that includes hingeably connected panels that can be configured to provide the container as illustrated in FIG. 1. Other suitable materials include wood, metal, corrugated fiberboard, paperboard, or other non-durable materials. The foldable material is printed (if desired), die-cut and scored to form a blank. These are then transported and stored flat, and erected at the point of filling with the mattress. The hingeably connected panels are defined by fold lines and generally include a bottom wall panel 22, a top wall panel 24 and sidewall panels 26 extending from the bottom wall panel 22 to the top wall panel 24 The foldable material further includes a rear face panel 28 and a front face panel 30. A folding carton (sometimes called a box) is fabricated from paperboard.

As noted above, the rigid container 14 consists of a bottom panel 22, a top panel 24, sidewalls 26 extending from the bottom panel 22 to the top panel 24, a front facing pane 301, and a rear facing panel 28 defined by the folding of the fold lines. The bottom panel 22 consists of a fold line shared with one of the sidewalls 26 and foldable tabs 31, 33, 35 at each free end. Tab 31 corresponding to a length dimension for the bottom panel is affixed to an interior facing surface of sidewall 26, i.e., an opposing one of the sidewalls, and tabs 33 and 35 corresponding to a width dimension for the bottom panel are affixed to the selected interior surfaces of the front and rear facing panels 28, 30, respectively. Similarly, top wall panel 24 consists of fold lines shared with each of the sidewalls and includes tab 37 that is affixed to a selected interior surface of the rear facing panel 28. It should be apparent that each of the rear and front facing panels 28, 30, respectively, includes two panels, which, when assembled, one of the panels is affixed to an interior surface of the other panel. Each sidewall 26 consists of fold lines shared with the front panel and fold lines shared with the rear panel, wherein the front panel has a shorter length than the rear panel such that when the container is seated on the bottom panel during display, the container has an opening exposing at least a portion of the mattress. Advantageously, doubling the panels in this manner increases the rigidity of mattress packaging display. Affixing the various panels and tabs to assemble the container can include any attachment means including, but not limited to, applying a suitable adhesive, use of hook and loop fasteners, staples, combinations thereof, and the like. Once assembled, the mattress packaging display 10 including the mattress 12 contained therein can be vertically oriented by seating the display on the bottom panel 28 such that the opening 16 and mattress contained therein are visible to the end user. Advantageously, this permits a retail store to provide a free standing display of the mattress packaging display by itself or in groups while eliminating the need for additional and costly support structures to maintain the upright positioning of the mattress. Moreover, the mattress packaging display including the relatively rigid container 14 can be easily moved from one location to another as opposed to the difficulty in moving the more flexible mattress by itself. The mattress packaging display may further include openings and/or handles (not shown) to facilitate movement of the display from one location to another.

In some embodiments, the mattress may first be packaged with plastic film (not shown) prior to containment within the container 14. The plastic film can be transparent and does not interfere with the container 14. The plastic film protects the mattress from possible contamination and/or damage.

In some embodiments, the container 10 further includes a visual and/or tactile display tab 18 attached to the container. The visual and/or tactile display tab 18 can be disposed distally or proximate to the opening 16 depending on the intended application. The visual and/or tactile display tab can include at least a portion of the material defining the mattress 12 and/or indicia 20 providing information about the mattress, e.g., manufacturer, bed type, coil amount, foam type, and the like. For example, the ticking of the mattress contained therein can be provided as well as the manufacturer name, bed size and/or model type. As used herein, the ticking generally refers to the protective fabric cover which encases the mattress. It is usually designed to coordinate with the foundation border fabric and comes in a wide variety of colors and styles. Mattress fabrics can be knits, damask or printed wovens, or inexpensive nonwoven. For foam mattresses, the visual and/or tactile display may include a portion of the foam mattress.

Figure 3:
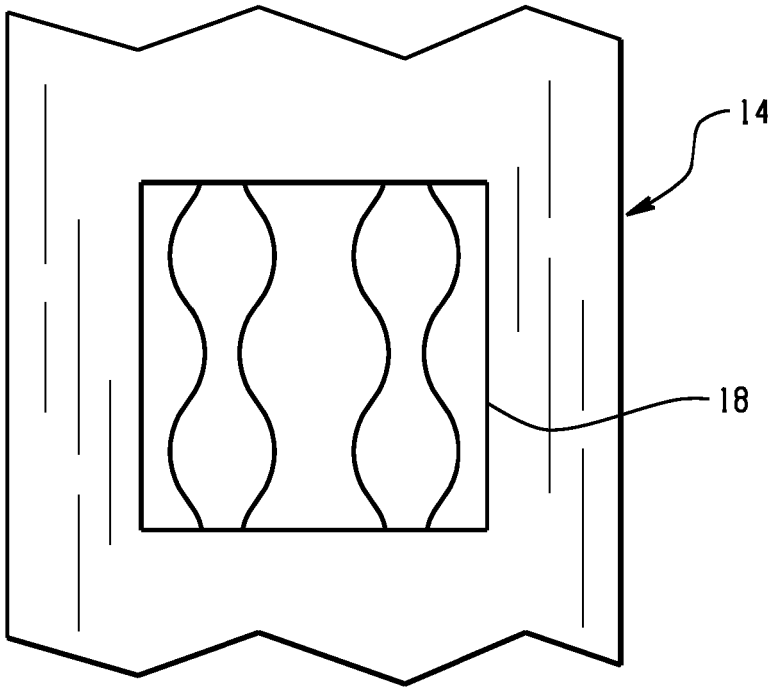
FIG. 3 illustrates a visual and/or tactile display tab for use with the mattress packaging display.

FIG. 3 depicts an exemplary visual and/or tactile display tab 18. The tab shown is generally rectangular in shape but may be of any shape and depicts ticking that is representative of the ticking of the mattress contained within the display container 14. The ticking provides an end user the opportunity to for tactile interaction as well as visual interaction of fabric that is representative of the mattress contained within the display container. This is especially desirable for some environments since the mattresses are typically wrapped within a plastic film that provide poor visibility and are generally inaccessible for tactical interaction prior to the actual mattress purchase. Instead of, or in combination with the ticking, the tactile component of tab may include may include portions representative of different types of mattress topper pads, side panels, additional upholstery layers and non-upholstery layers.

At least one end of the tab 18 is affixed to an exterior surface of the container 14, generally at a location readily visible and convenient to the consumer. In some embodiments, the tab may provide by itself or in combination with a tactile component, information about the mattress such as number of coils, type of foam, various benefits, and the like.

Figure 4:
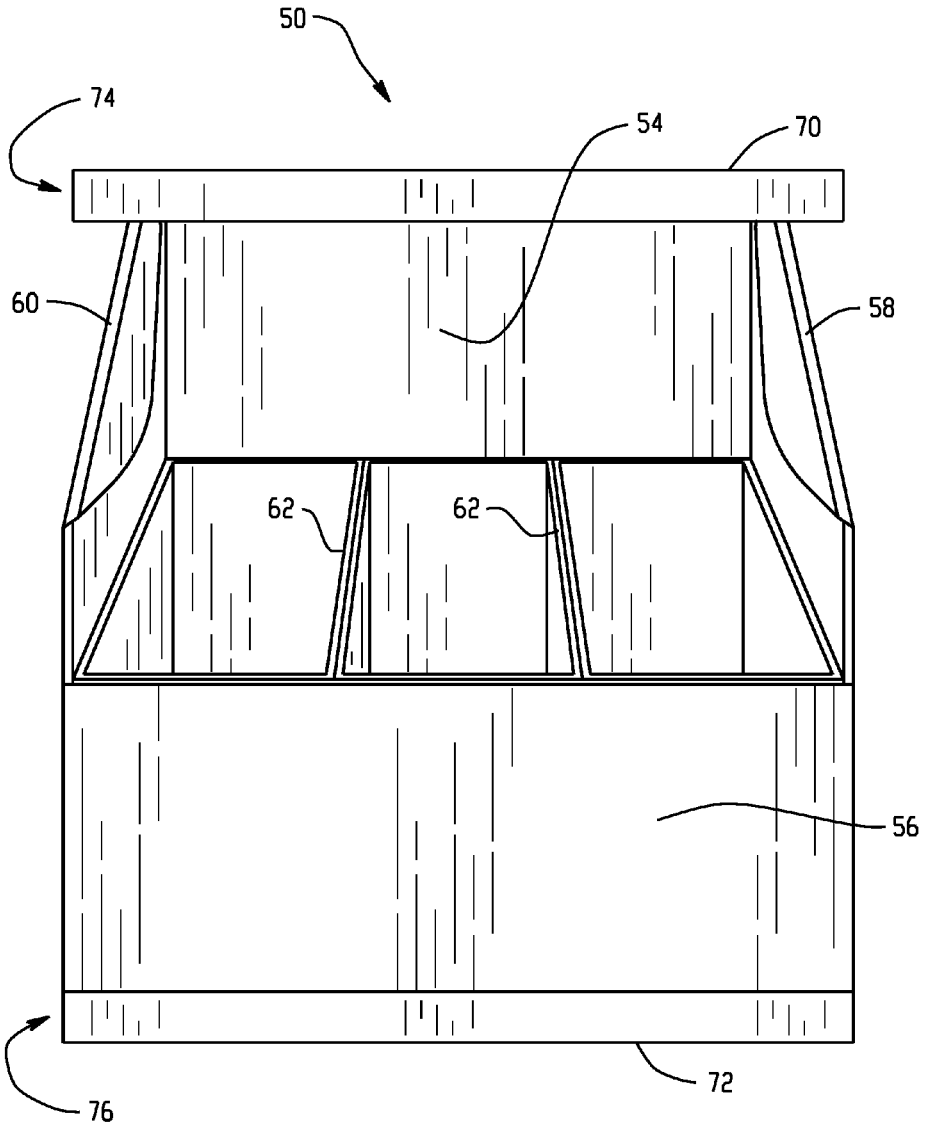
FIG. 4 illustrates a perspective view of a mattress packaging display configured to display multiple mattresses in accordance with another embodiment of the present disclosure.

In another embodiment, a mattress packaging display 50 is configured to display multiple mattresses as generally shown in FIG. 4. The mattress packaging display 50 includes a bottom wall (not shown) and sidewalls 54, 56, 58, and 60 extending therefrom so as to define an open end 62 that is generally dimensioned to accommodate insertion (and removal) of multiple mattresses to be packaged and displayed, wherein the mattresses are standing on end. Standing the mattresses on end is generally preferred to ease insertion and removal of the mattresses and also provide the end user line of sight to at least a portion of each mattress contained and packaged in the display. Sidewall 54 is a back facing panel when the display is positioned for display and opposing sidewall 56 is a front facing panel. The back facing panel 54 has a length that is substantially equal to the standing length of the mattress intended to be displayed and packaged whereas the front facing panel 56 is at a fraction of the standing length of the displayed mattress. In one embodiment, the front facing panel 56 is at about half the length of the intended mattress to be displayed. Sidewalls 58 and 60 are transversely coupled to the back and front facing panels 54 and 56, respectively.

In one embodiment, sidewalls 58 and 60 have a height substantially equal the back facing panel 54 for at least a portion transversely extending from the back facing panel. The remaining portion of sidewalls 58 and 60 to the front facing panel 56 transitions to a height substantially equal to or greater than the height of the front facing wall 56. The particular shape of the height transition is not intended to be limited and may be stepped, gradual, arcuate-shaped or the like. For ease in manufacturing the mattress display, the sidewalls 58 and 60 can be mirror images of one another.

Extending from the back facing panel 54 to the front facing panel 56 and spaced apart from sidewalls 58 and 60 are one or more dividers 62 generally dimensioned to accommodate the width of the packaged mattress. The dividers 62 can extend to the bottom wall as may be desired for some applications and are configured to maintain the standing position of the mattress, which permits removal of one or more mattresses from the packaging display without sacrificing stability of the container or the remaining standing mattresses within the display packaging 50.

The mattress packaging display 50 can further include upper and lower lids 70 and 72, respectively, for attachment to top 74 and/or bottom ends 76 of the packaging display. When used, the lids provide the packaging display with increased structural rigidity. At the top end, because the length of the sidewalls 58, 60 generally decreases from the back facing panel to the front facing panel, a consumer can still view the mattresses displayed within the packaging display even with the upper lid secured to the container herein whereas the mattresses can be readily inserted or removed from the packaging display by removal of the upper lid should such action be desired.

Figure 5:
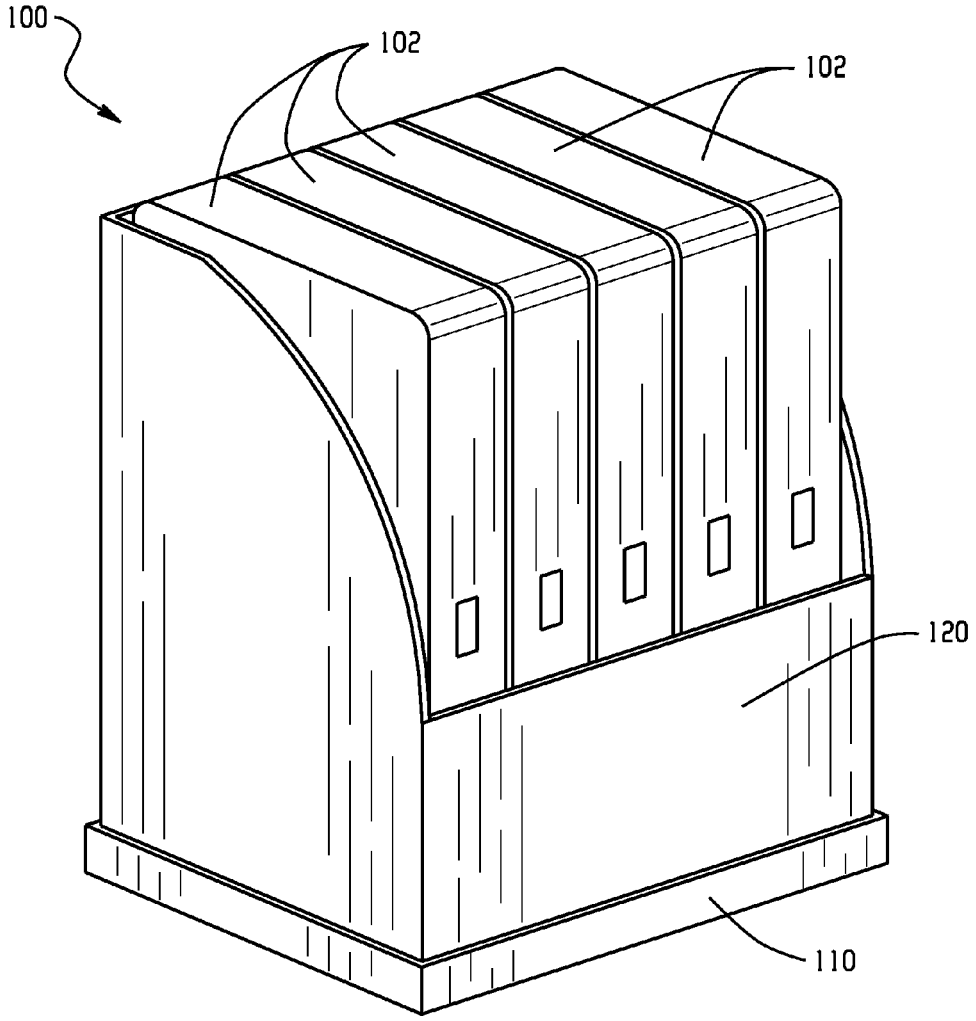
FIG. 5 illustrates a perspective view of a mattress packaging display configured to display multiple mattresses in accordance with an embodiment of the present disclosure.
Figure 6:
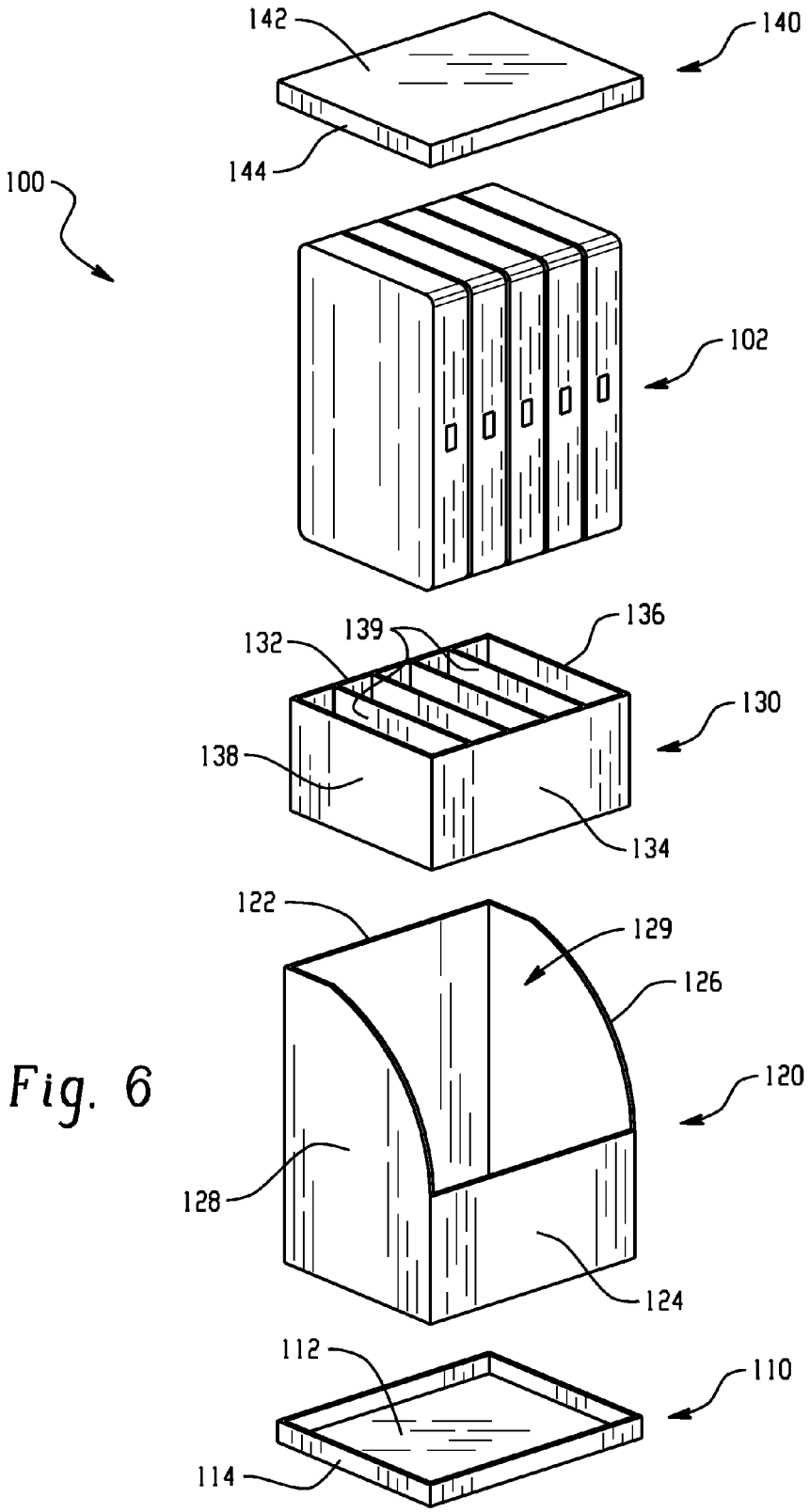
FIG. 6 illustrates an exploded view of the mattress packaging display of FIG. 5.

Turning now to FIGS. 5 and 6, there is depicted mattress packaging display 100 in accordance with another embodiment of the present disclosure. The illustrated mattress display 100 is configured for display of five upright twin sized mattresses generally designated by reference numeral 102. However, it should be noted that the mattress display 100 can be configured for more or less mattresses depending on the desired application as well as different sized mattresses. In one embodiment, the mattresses within the mattress display have similar dimensions. In other embodiments, the mattresses within the display have different dimensions. Also, it should be apparent that if different sized mattresses are packaged within the display, these mattresses may be flush mounted against the front facing panel or the back facing panel depending on the desired application.

Referring to the exploded view of the mattress display 100 in FIG. 6, the mattress packaging display 100 includes a bottom cap 110 upon which the mattresses are seated; a wrap 120, divider tubes 130 disposed within the wrap 120; and a top cap 140.

The bottom cap 110 includes a substantially planar panel 112 and upwardly extending sidewalls 114, relative to ground, extending about a perimeter of the panel. The bottom cap can have a substantially square shape or substantially rectangular shape depending on the number and size of the mattresses to be displayed within the mattress display.

The wrap 120 includes sidewalls 122, 124, 126, and 128 extending therefrom so as to define an open end 129 that is generally dimensioned to accommodate insertion (and removal) of multiple mattresses to be packaged and displayed, wherein the mattresses are standing on end. Standing the mattresses on end is generally preferred to ease insertion and removal of the mattresses and also provide the end user line of sight to at least a portion of each mattress contained and packaged in the display. Sidewall 122 is a back facing panel when the display is positioned for display and opposing sidewall 124 is a front facing panel. The back facing panel 122 has a length that is substantially equal to the standing length of the mattress intended to be displayed and packaged whereas the front facing panel 124 is at a fraction of the standing length of the displayed mattress. In one embodiment, the front facing panel 124 is at about half the length of the intended mattress to be displayed. Sidewalls 126 and 128 are transversely coupled to the back and front facing panels 122 and 124, respectively.

In one embodiment, sidewalls 126 and 128 have a height substantially equal the back facing panel 122 for at least a portion transversely extending from the back facing panel. The remaining portion of sidewalls 126 and 128 to the front facing panel 124 transitions to a height substantially equal to or greater than the height of the front facing wall 124. The particular shape of the height transition is not intended to be limited and may be stepped, gradual, arcuate-shaped or the like. For ease in manufacturing the mattress display, the sidewalls 126 and 128 can be mirror images of one another. Graphics may be displayed on any of the sidewalls 122, 124, 126, and 128 as may be desired for some applications.

The divider tubes 130 are disposed within the wrap 120 and are configured to maintain the standing position of an individual mattress, which permits removal of one or more mattresses from the packaging display without sacrificing stability of the mattress display or the remaining standing mattresses within the display packaging 100. The divider tube includes back and front facing sidewalls 132, 134, respectively, and sidewalls 136 and 138 transversely extending therebetween. The sidewalls 132, 134, 136, and 138 are generally dimensioned to be inserted into and abut against the corresponding sidewalls defining the warp 120. It should be apparent that sidewalls defining the divider tube have a height less than a height of a corresponding sidewall in the wrap 120. The divider tube further includes one or more partitions 139 extending from the back facing sidewall 132 to a front facing sidewall 134. The top cap 140 includes a substantially planar panel 142 and downwardly extending sidewalls 144, relative to ground, extending about a perimeter of the panel. The top cap can have a substantially square shape or substantially rectangular shape depending on the number and size of the mattresses to be displayed within the mattress display.

Figure 7B:
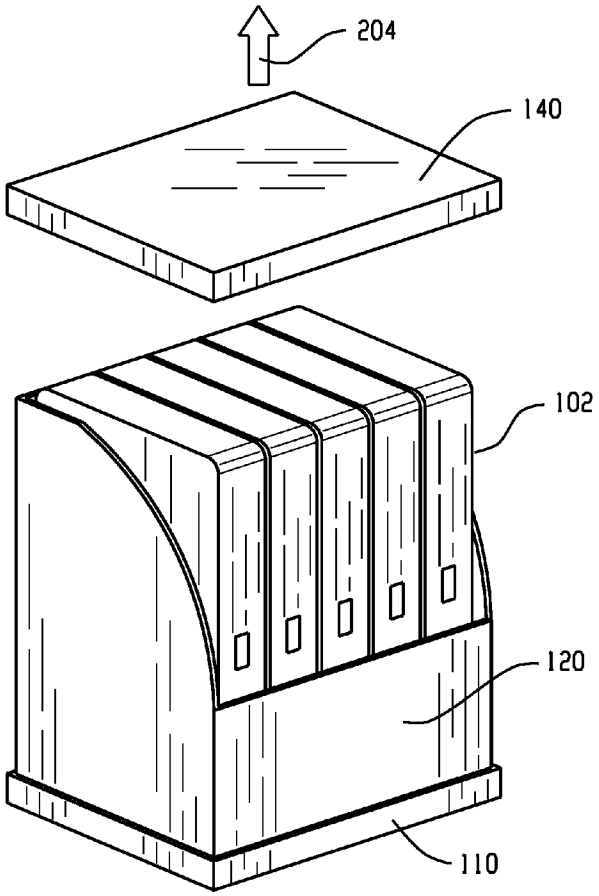
FIGS. 7A and 7B illustrate a process for setting up the mattress display for viewing and use by an end user.
Figure 7A:
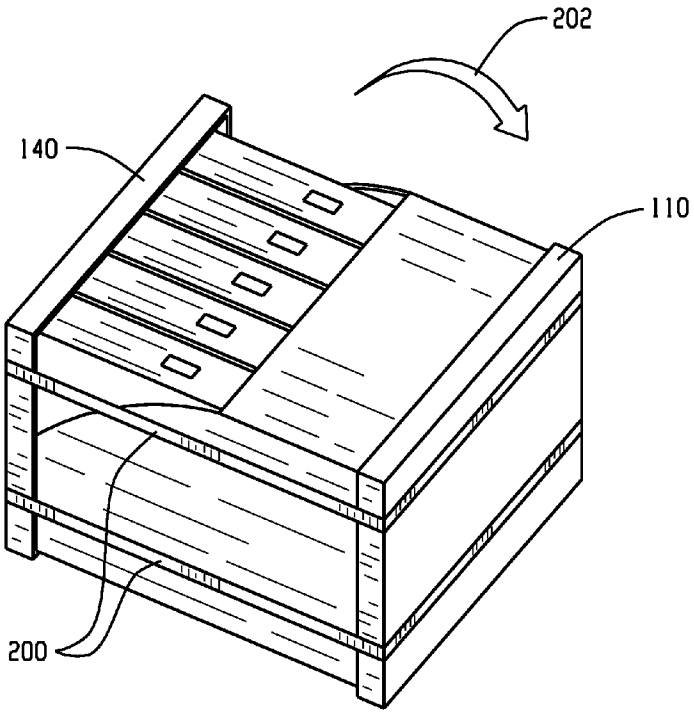

FIGS. 7A and 7B illustrate the mattress packaging display 100 configured for transport and set up for display. As shown in FIG. 7A, during transport, one or more bands 200 can be employed about the mattress packaging display to contain the various components defining the mattress packaging displayer and the mattresses contained therein. The mattress packaging display can be transported with the mattresses seated upright and lengthwise within the mattress packaging display as shown or may be seated upright widthwise (i.e., the head end or foot end). To set up at a site such as a store, the display is positioned in an upright position for display as shown by arrow 202. In FIG. 7B, the bands and top cap are removed as shown by arrow 204.

Mattress packaging displays 10, 50, and 100 may further include a visual and/or tactile display tab as previously described. Likewise, the surfaces of the mattress packaging display may include indicia as well as pictures to provide, for example, additional information about the manufacturer, the mattresses contained with the packaging display as well as benefits and features of the mattresses being displayed, among other information.

The mattresses are seated upright within the mattress displays. In some embodiment, the mattresses are seated on the foot or head end of the mattress as is generally shown in the Figures. In other embodiments, the mattresses are seated on a selected side.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mattress packaging display comprising:

a mattress disposed in a rectangular and rigid container;

wherein the rectangular and rigid container consists of a bottom panel, a top panel, sidewalls extending from the bottom panel to the top panel, a front facing panel, and a rear facing panel;

wherein the bottom panel consists of a fold line shared with one of the sidewalls and foldable tabs at each free end, wherein one of the foldable tabs corresponding to a length dimension for the bottom panel is affixed to an interior facing surface to an opposing one of the sidewalls, and the foldable tabs corresponding to a width dimension for the bottom panel are affixed to selected interior surfaces of the front and rear facing panels, wherein the top panel consists of fold lines shared with each of the sidewalls and a foldable tab that is configured for attachment to the rear facing panel, wherein each sidewall consists of fold lines shared with the front panel and fold lines shared with the rear panel, wherein the front panel has a shorter length than the rear panel such that when the container is seated on the bottom panel during display, the container has an opening exposing at least a portion of the mattress.

2. The mattress packaging display of claim 1, wherein the mattress is plastic wrapped.

3. The mattress packaging display of claim 1, wherein the container is formed of a material comprising card, cardboard, wood, metal, corrugated fiberboard, paperboard, or combinations thereof.

4. The mattress packaging display of claim 1, further comprising a visual and/or tactile display tab affixed to and/or integrated in an exterior surface of the container and positioned for interaction with an end user.

5. The mattress packaging display of claim 4, wherein the visual and/or tactile comprises at least a portion of a mattress representative of the mattress contained within the container.

6. The mattress packaging display of claim 4, wherein the visual and/or tactile comprises a mattress ticking representative of a mattress ticking of the mattress contained within the container.

7. The mattress packaging display of claim 5, wherein the container further comprises display information on one ore more surfaces of the bottom panel, the top panel, and the opposing sidewalls extending from the bottom panel to the top panel.

8. A display container for displaying and packaging multiple mattresses, the display container comprising:

one or more mattresses;

a bottom panel at a bottom end of the packaging display;

opposing sidewalls extending from the bottom panel;

a front facing panel transversely extending between the sidewalls having a height at a fraction of a height of the one or more mattresses to be displayed;

a rear facing panel transversely extending between the sidewalls having a height substantially equal to the height of the one or more mattresses to be displayed, wherein the opposing sidewalls include a portion extending from the rear facing panel having a height that is substantially equal to the height of the rear facing panel and a remaining portion that extends to the front facing panel and transitions to a height greater than or equal to the height at the front facing wall, wherein the one or more mattresses are each disposed within a recess defined by the bottom panel, the opposing sidewalls, and the front and rear facing panels; and a visual and/or tactile display tab affixed to and/or integrated in an exterior surface of the container and positioned for interaction with an end user.

9. The display container of claim 8, further comprising one or more dividers between the opposing sidewalls extending from the front facing panel to the back facing panel to provide a width effective to accommodate a width of one of the multiple mattresses to be displayed and packaged in the display container.

10. The display container of claim 8, further comprising a lid disposed at a selected one of a bottom end, a top end or a both the bottom and top ends of the display container, wherein the lid disposed at the top end is configured to permit an end user to view at least a portion of the mattresses in the display container.

11. A mattress packaging display for packaging during transport and displaying mattresses at a site, the display comprising:

one or more mattresses;

a bottom cap upon which the one or more mattresses are seated, the bottom cap comprising a panel and sidewalls upwardly extending about a perimeter of the panel;

a rigid wrap comprising a front facing panel, a back facing panel, and sidewalls transversely extending from the back facing panel to the front facing panel, wherein the back facing panel has a height about equal or greater than a length of the one or more mattress to be displayed therein, and wherein the front facing panel has a height at a fraction of the height of the back facing panel to permit display of the one or more mattresses, wherein the sidewalls include a portion extending from the rear facing panel having a height that is substantially equal to the height of the rear facing panel and a remaining portion that extends and transitions to the front facing panel; and divider tubes disposed within the wrap for partitioning one or more mattresses within the mattress packaging display.

12. The mattress packaging display of claim 11, further comprising a top cap, wherein the top cap comprises a panel and sidewalls downwardly extending about a perimeter of the panel.

13. The mattress packaging display of claim 11, further comprising graphics disposed on an exterior surface of the wrap.

14. The mattress packaging display of claim 11, further comprising a visual and/or tactile display tab affixed to and/or integrated in an exterior surface of the container and positioned for interaction with an end user.

15. The mattress packaging display of claim 11, further comprising one or more bands about the display for containing the display during transport.

* * * * *